US005323987A

United States Patent [19]

Pinson

[11] Patent Number: 5,323,987

[45] Date of Patent: Jun. 28, 1994

[54] MISSILE SEEKER SYSTEM AND METHOD

[75] Inventor: George T. Pinson, Huntsville, Ala.

[73] Assignee: The Boeing Company, Seattle, Wash.

[21] Appl. No.: 26,028

[22] Filed: Mar. 4, 1993

[51] Int. Cl.[5] ..... F41G 7/26

[52] U.S. Cl. ..... 244/3.16; 244/3.17

[58] Field of Search ..... 244/3.15, 3.16, 3.17, 244/3.11; 358/109

[56] References Cited

U.S. PATENT DOCUMENTS

| | | | |
|---|---|---|---|
| 4,152,724 | 5/1979 | Hunter | 358/109 |
| 4,404,592 | 9/1983 | Pepin et al. | 358/125 |
| 4,430,673 | 2/1984 | Salomon et al. | 358/213 |
| 4,521,782 | 6/1985 | Pinson | 343/765 |
| 4,577,825 | 3/1986 | Pinson | 248/550 |
| 4,611,771 | 9/1986 | Gibbons et al. | 244/3.12 |
| 5,129,595 | 7/1992 | Thiede et al. | 244/3.16 |

FOREIGN PATENT DOCUMENTS

| | | |
|---|---|---|
| 2083968A | 3/1982 | United Kingdom . |
| 2185166A | 7/1987 | United Kingdom . |

*Primary Examiner*—Ian J. Lobo

*Attorney, Agent, or Firm*—Finnegan, Henderson, Farabow, Garrett, & Dunner

[57] ABSTRACT

A seeker system for a missile having a housing with a predetermined field-of-regard the system including an image detector adapted to be fixedly mounted to the housing having a predetermined number of pixels, an optical system fixedly mounted to the housing for scanning said predetermined field-of-regard ahead of the nose for focusing images in successive image frames onto the image detector, an image reader for reading image data from the image detector corresponding to each of the successive image frames, a display for displaying the image data of the successive image frames, a selector for selecting a displayed target from the field-of-regard, a comparator for comparing the image data of successive image frames, and a tracker for tracking the selected target by setting a course of the missile in a direction toward the target, a discriminator responsive to the compared frames for discriminating between a first deviation below a predetermined amount and a second deviation above the predetermined amount, a stabilizer responsive to the first deviation for stabilizing the display of the images, and a missile controller responsive to the second deviation for repositioning the missile to a desired course.

33 Claims, 10 Drawing Sheets

MISSILE SEEKER SYSTEM AND METHOD

BACKGROUND OF THE INVENTION

1. Field of the Invention

This invention relates to a seeker system and, more particularly, to a seeker system for seeking, displaying and tracking targets. Although the seeker system of the present invention is useful for many different types of systems for seeking, tracking and/or stabilizing target images, it is particularly useful for tactical missiles and is described herein in connection therewith.

2. Discussion of the Related Art

There have been a large number of seeker systems developed for use in tactical weapons systems. Seeker systems are used for sensing an object or target in the path of a missile, which have an optical head at a nose of the missile. The system includes a display for displaying the field-of-view from a field-of-regard (field-of-view being a focused portion of the field-of-regard) ahead of the missile, and a movement control for directing the missile in the direction of a selected target in the sensed field-of-view. The missile may be controlled also by a tracking system that is able to vary the direction of travel of the missile in accordance with the sensed position of the target. Typically, optical heads of such seeker systems are mounted on mechanical gimbals, in order to maintain a target in the optical field-of-view regard and the display during perturbations of the missile caused by external forces and movement of the target. Seekers, however, used in mortar and cannon launched systems, are Subjected to up to 20,000 g's upon firing requiring that the seeker survive a very hostile environment. Thus, high acceleration loads not only require special handling of the seeker, but also increase the cost of the missile system due to the special engineering and manufacturing efforts required. Additionally, it is difficult to use mechanical gimbal mounted seeker heads in small tactical missiles, such as mortars of 81 mm and 120 mm, for example, because of their size.

SUMMARY OF THE INVENTION

The present invention has been made in view of the above circumstances and has as an object of providing a seeker system for a missile that overcomes the above disadvantages.

Another object of the present invention is to provide a seeker system that is suitable for use with any size missile yet is relatively economical to manufacture.

Additional objects and advantages will be set forth in part in the description which follows and in part will be obvious from the description, or may be learned by practice of the invention. The objects and advantages of the invention may be realized and obtained by means of the instrumentalities and combinations particularly pointed out in the appended claims.

To achieve the objects and in accordance with the purpose of the invention, as embodied and broadly described herein, a seeker system for a missile having a housing is provided comprising means fixedly mounted to the housing for detecting images, the detecting means having a predetermined number of pixels, an optical system fixedly mounted to the housing disposed to scan a predetermined field-of-regard for focusing images in successive image frames onto the image detecting means, means for reading image data from the image detecting means corresponding to each of the successive image frames, the reading means including an array map having coordinates for locating each of the pixels of each successive image frame, the array map including a central coordinate, means for displaying a portion of the image data of each of the successive image frames from the array map, means for determining an instantaneous coordinate position of the displayed image from each successive image frame in the array map, means for calculating a distance from the determined position of the displayed image in the array map to a predetermined coordinate position in the array map, and means responsive to the calculated distance for controlling the missile to move the displayed image toward the central coordinate of the array map in accordance with the calculated distance.

In another aspect of the present invention, a seeker system for a missile having a housing is provided comprising means fixedly mounted to the housing for detecting images, the detecting means having a predetermined number of pixels, an optical system fixedly mounted to the housing disposed to scan a predetermined fie d-of-regard for focusing images in successive image frames onto the image detecting means, means for reading image data from the image detecting means corresponding to each of the successive image frames, means for displaying the image data of the successive image frames, means for selecting a displayed target from the field-of-regard, means for comparing the image data of the successive image frames, means for tracking the selected target by setting a course of the missile in a direction toward the target, means responsive to the compared frames for discriminating between a first deviation below a predetermined amount and a second deviation above the predetermined amount, means responsive to the first deviation for stabilizing the display of the images, and means responsive to the second deviation for repositioning the missile to the set course.

The accompanying drawings, which are incorporated in and constitute a part of this specification, illustrate embodiments of the invention and, together with the description, serve to explain the objects, advantages and principles of the invention.

DETAILED DESCRIPTION OF THE PREFERRED EMBODIMENTS

Figure 1:
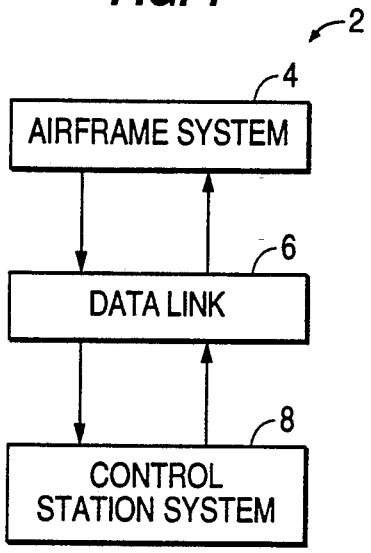
FIG. 1 is an overall block diagram illustrating a system incorporating the present invention.

The apparatus of the present invention will be described in detail referring to the illustrations in the accompanying drawings, in which like reference characters designate like or corresponding parts throughout the drawings.

The present invention is an electronically stabilized airframe or missile seeker system. The seeker system may include a data link to connect the airframe portion of the system to a control station. As shown in FIG. 1, a seeker system 2 includes an airframe portion 4 which communicates with a control station 8 through a data link 6. The data link 6 may be fiber optically controlled, hardwire controlled, RF controlled, or controlled by a combination of all three. For example, for a fiber optically controlled data link, the control station is linked with the seeker through a long stretch of fiber optic cable wound in a bobbin. However, any suitable data link may be used to transfer data from the airframe portion 4 to the control station 8.

The airframe portion 4 primarily produces raw image data, including any image defects due to, for example, vibrations and shock of the airframe. The raw image data are transmitted to the control station 8 where the raw image data are processed to track a selected target while producing a stable, clear image including the target on a display. The control station 8 sends control commands to the airframe portion 4 to maneuver the missile carried airframe portion toward the selected target.

Figure 2:
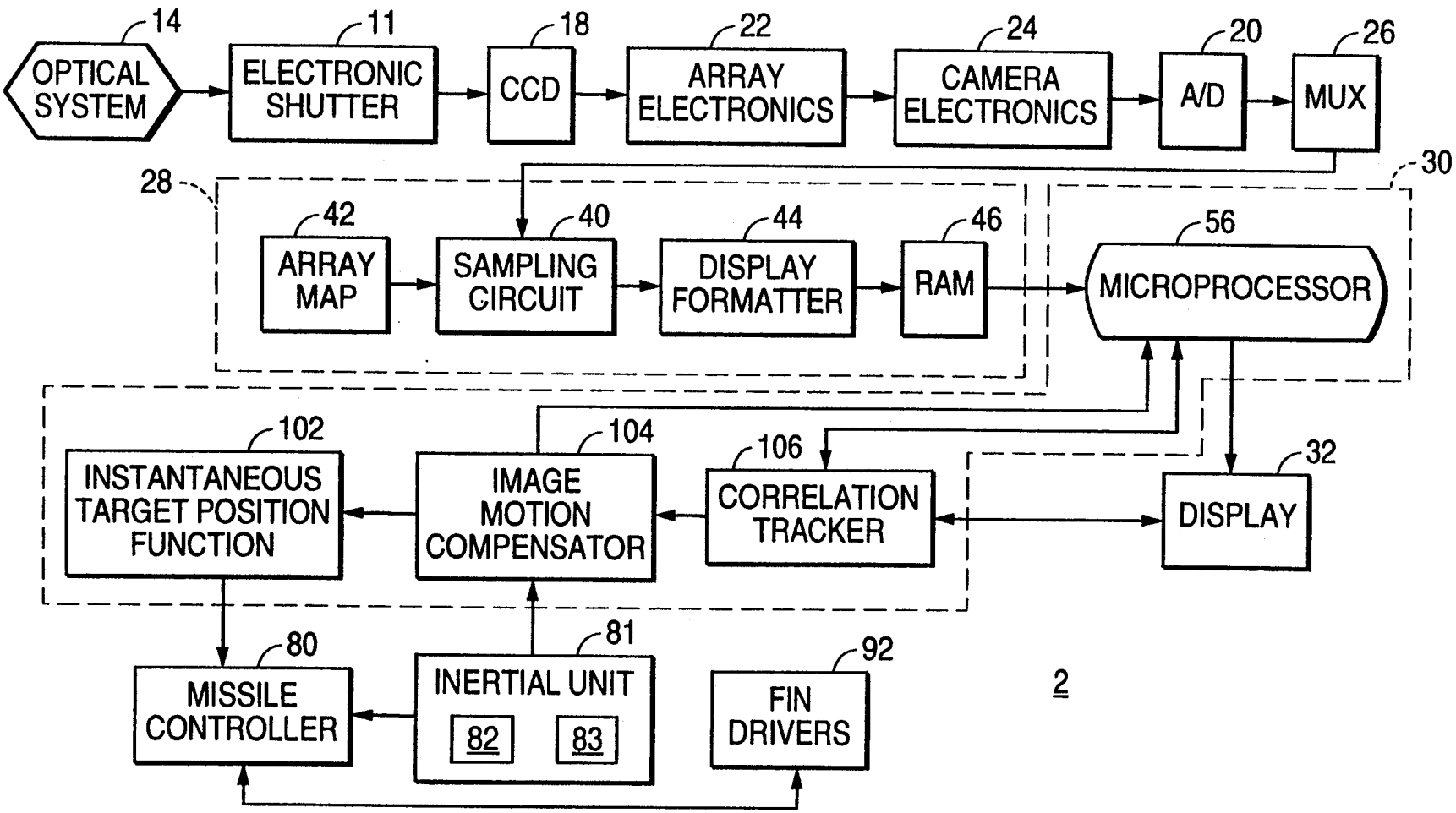
FIG. 2 is a schematic block diagram of a seeker system according to one embodiment of the present invention.

Referring to FIG. 2, the seeker system 2 includes an optical system 14, an electronic shutter 11, a charge-coupled device (CCD) array 18, array electronics 22, camera electronics 24, an analog to digital (A/D) converter 20, and a multiplexer 26. The seeker system includes a digital signal processor 28, which includes an array map 42, sampling circuit 40, display formatter 44, and a random access memory (RAM) 46. The seeker system 2 also includes a main controller 30, which includes a microprocessor 56, an instantaneous target position function 102, an image motion compensator 104, and a correlation tracker 106. The seeker system 2 further includes a display 32, a missile controller 80, an inertial unit 81 including rate sensors 82 and accelerometer 83, and fin driver and position controller 92.

In accordance with the present invention, a seeker system is provided including an optical system fixedly mounted to a housing, such as a missile, disposed to scan a predetermined field-of-regard for generating images.

Figure 3:
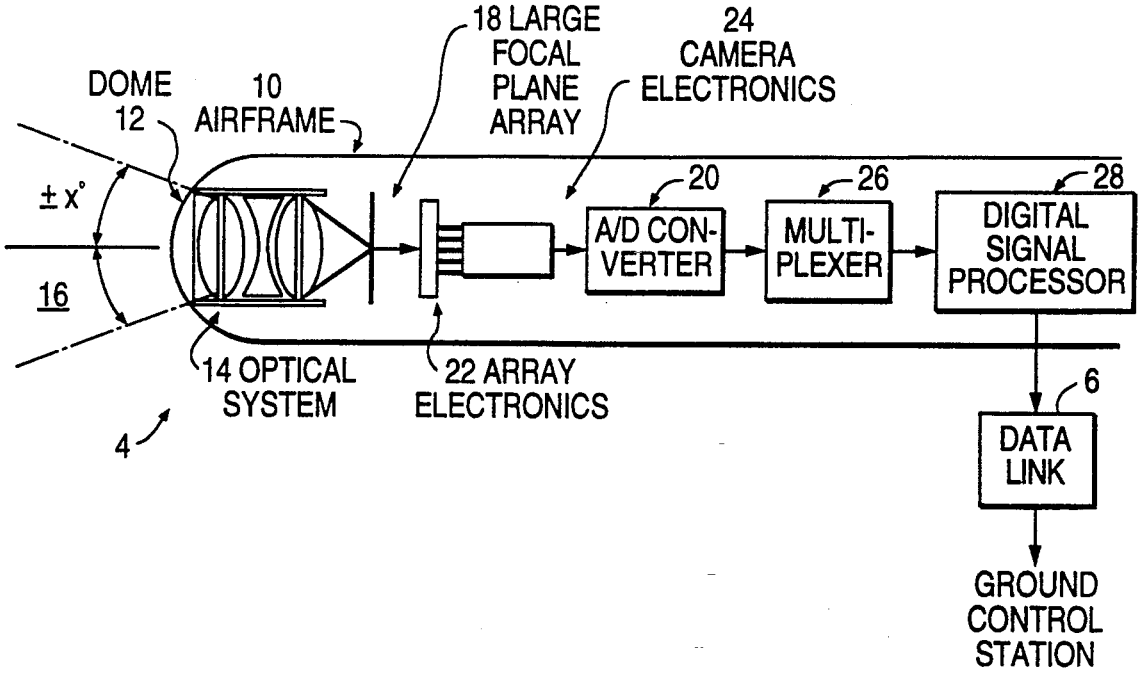
FIG. 3 is a schematic block diagram of the system of FIG. 1 illustrating in more detail an embodiment of the airframe portion of the present invention.

As embodied herein and referring to FIG. 3, seeker system 2 includes an optical system 14 fixedly mounted to an airframe housing 10. A dome or nose 12 of airframe housing 10, which supports the optical system 14, allows for a wide field-of-regard 16 that permits fields-of-regard, for example, of approximately 30° or greater in accordance with the invention.

Suitable optical systems may be used in the present invention to provide a wide field-of-view, such as described in U.S. Pat. No. 4,521,782 entitled "Target Seeker Used In A Pointer And Tracking Assembly," U.S. Pat. No. 4,577,825 entitled "Ocular Pointing And Tracking Device," and U.S. Pat. No. 4,812,030 entitled "Catoptric Zoom Optical Device," which are all commonly assigned to the assignee of this application. These three patent references are incorporated by reference herewith.

The seeker system includes means fixedly mounted to the airframe for detecting images. The image detecting means is an array of detectors such as a charge-coupled device (CCD) array or an infrared focal point array having a predetermined number of pixels. The image generated from the optical system is focused onto the image detecting means through an electronic shutter which repetitively produces individual frames of the image in succession.

Referring to FIG. 3, a scanned image from the optical system 14 is focused onto a CCD array 18, for example, through an electronic shutter 11 (FIG. 2) of variable speed. The electronic shutter 11 controls the amount of light entering the seeker system. CCD array 18 is a large focal plane array, which may be defined as an array that is larger than required to fill a monitor screen such as a conventional television screen of 528×360 pixels, for example. Therefore, a high density array with a number of pixels about 1,000×1,000, for example, may be considered to be a large focal plane array. Standard CCDs, such as currently used in commercial solid state TV cameras, are suitable for the present invention.

Arrays such as CCD array 18 may contain a single or multiple CCDs. An advantage of multiple CCDs may be that a high resolution image can be achieved without sacrificing the field-of-view. The multiple CCDs are capable of accommodating a large quantity of pixels on which the image may be focused. Thus, although the size of the individual pixels are fixed, more pixels will intercept light from a same portion of the image than an array with fewer CCDs, and therefore, fewer pixels. Hence, a high resolution image is possible while maintaining a large field-of-view. Nevertheless, a single CCD may replace multiple CCDs in an array without sacrificing resolution if the single CCD contains an equivalent number of pixels.

The seeker system includes means for reading digital image data from the image detecting means corresponding to each of the successive image frames.

Referring to FIG. 3, the array electronics 22 reads the lines of pixels in an order from the CCDs 18, frame by frame, in accordance with the electronic shutter 11 having variable shutter speed. The lines of pixels are read in order so that they can be reconstructed to produce an array map which provides coordinates for the pixel positions within each image frame. Each image frame is analyzed in reference to its previous image frame.

The seeker system includes means for converting each of successive image frames from the image detecting means into digital data.

As shown in FIG. 3, the optical system 14 provides a wide field-of-regard that permits the target image to be focused onto the CCD array 18. All of the readouts from the CCD array 18 are digitized to a desired gray scale by A/D converters 20, and thereafter, all CCD element calibrations and manipulations are performed in a digital mode. Each A/D converter 20 is used for each or parts of a CCD, as necessary, to maintain a desired analog to digital conversion speed. Multiple A/D converters may be used for each CCD for higher conversion speeds. The A/D conversion speeds can be varied according to the electronic shutter speed.

The seeker system includes means for calibrating the pixels of the CCD array in accordance with the digital image data.

Figure 4:
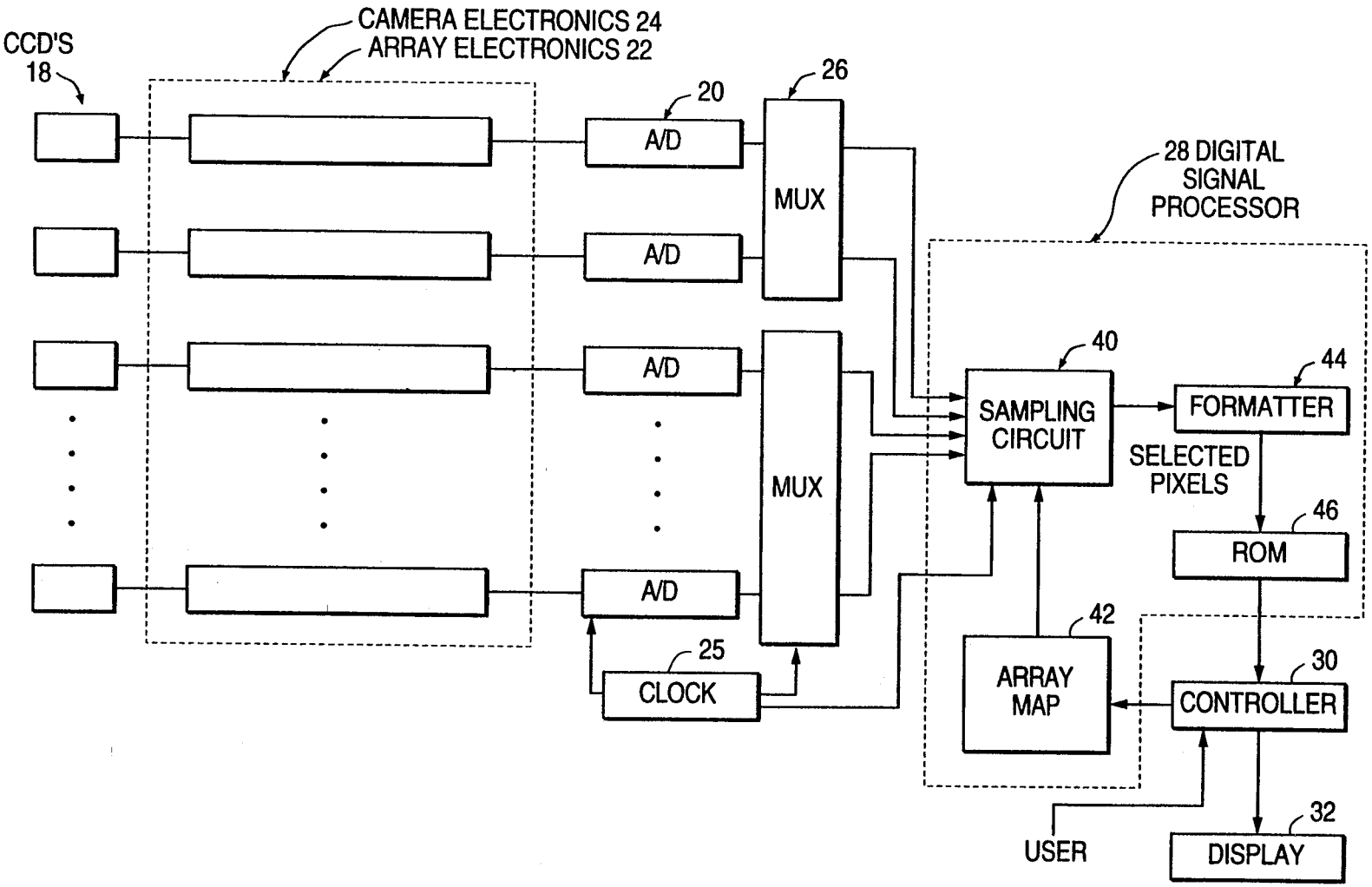
FIG. 4 is a more detailed block diagram of the airframe portion of the seeker system of the present invention in FIG. 3.

Camera electronics 24 calibrates the pixels of the CCD array 18 to correct for sensitivity differences from pixel to pixel. The calibration can be performed before the actual operation of the seeker system, i.e. calibration may be performed only once before launching the missile. The calibration may be done in analog (as shown in FIG. 3 and 4), in which case the camera electronics 24 receives analog data from the array electronics 22, or in digital, in which case the camera electronics 24 receives digital data from the A/D converter 20.

In accordance with the present invention, the image detecting means may include coherent optical fiber bundles to connect the optical system to the array. This is a modified version of the image detecting means and includes multiple CCDs connected to the optical fiber bundles. In particular, a coherent optical fiber bundle is separated into a plurality of individual coherent optical fiber bundles. The image is focused onto the optical fiber bundle by the optical system. The focused image information from the optical fiber bundle is received by the CCD array through each corresponding individual bundles. Each CCD, having a predetermined number of pixels, is connected to a corresponding end of each individual coherent optical fiber bundle.

Figure 6:
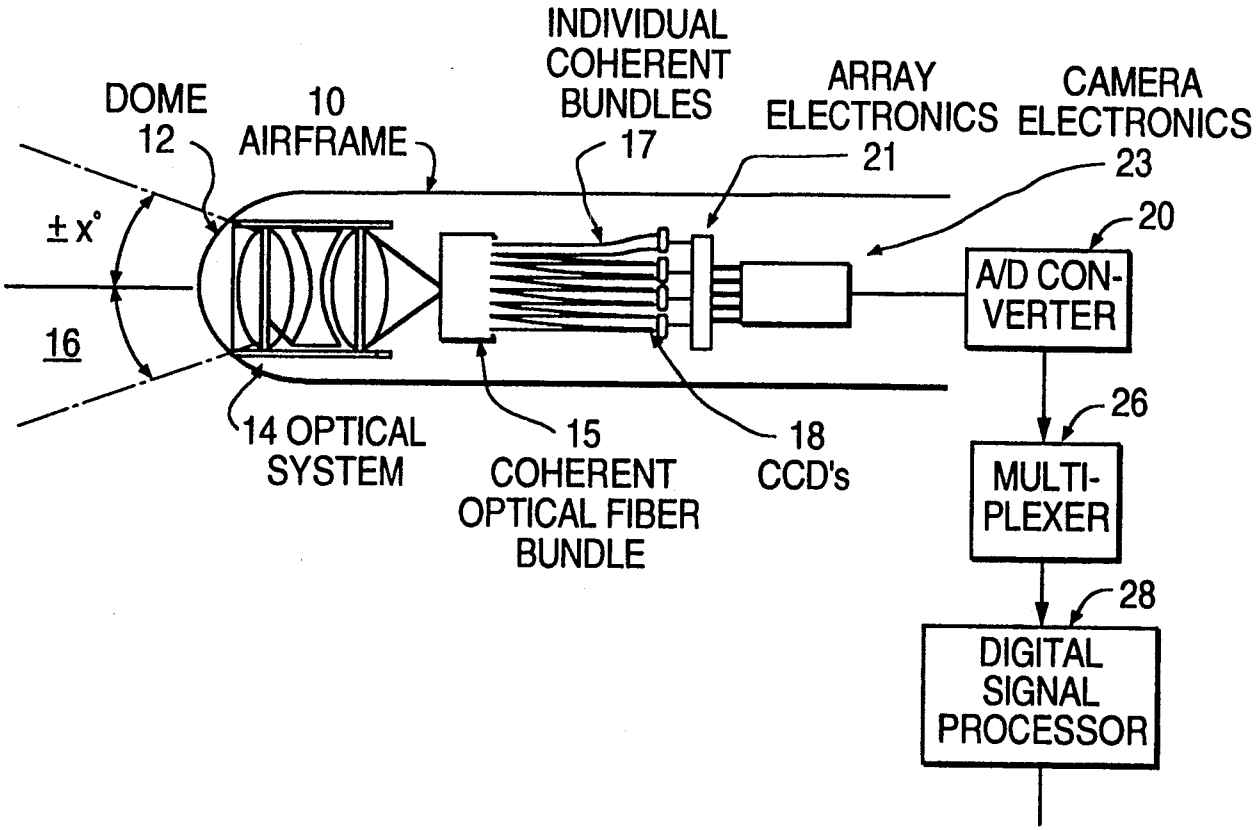
FIG. 6 is an alternative embodiment of the airframe portion of FIG. 3.

As embodied herein and referring to FIG. 6, the image received by the optical system 14 is focused onto a coherent optical fiber bundle 15, which is separated into individual coherent bundles 17. The number of individual coherent bundles 17 depends on the number of required CCDs 18. The coherent fiber bundles 17 permit the individual fibers that make up the initial large bundle 15 to be traceable back to the individual CCDs 18 so that the image can be reconstructed.

Each of the individual CCDs 18 are attached to polished ends of the corresponding strands of the optical fiber bundles 17. Accordingly, the sensitive area of the individual CCDs 18, typically 6 mm to 8 mm on an edge, must correspond with the end area of the individual coherent optical fiber bundles 17. Therefore, the end area of the individual coherent optical fiber bundles 17 has dimensions equal to that of the sensitive area of each CCD 18.

To illustrate the dimensions of the coherent optical fiber bundles and the CCDs, the following example is provided. A 3×3 array of CCDs may be required to provide full coverage of an area to be examined. If each CCD has a dimension of 6 mm×8 mm on a side, the 9 CCDs would form a rectangle of 18 mm would require that the corresponding end area of the fiber bundle measure 18 mm×24 mm and the main bundle 15 be separated into a total of 9 individual coherent bundles 17. Therefore, the size of the end of the main bundle 15 on which the image is focused will be determined from consideration of the field-of-view, the size of the sensitive areas on the CCDs 18, the size of the focal plane, and the resolution of the monitor screen 32. In this example, in essence, a total of 9 cameras are looking out of the coherent optical fiber bundle 15.

The CCD array 18 of the modified embodiment may be attached directly to array electronics 21 to permit synchronization and signal readouts from the CCD array 18. The array electronics 21 reads the image signals (analog) from the CCD array 18 and has similar functions as discussed before. Camera electronics 23 applies pre-amplification and formatting functions to the image signals from the array electronics 21 to calibrate the CCD output in analog. Camera electronics 23 of the modified embodiment primarily includes individual pre-amplifiers to condition the CCD readout to a desired level. However, as in the embodiment of FIG. 3, the camera electronics 23 may calibrate the CCD output in digital. Also, as in the embodiment of FIG. 3, the array electronics 21 process analog signals which are then digitized by the A/D converters 20. All other portions of the modified embodiment of the seeker system of FIG. 6 are similar to the embodiment of FIG. 3.

The reading means of the seeker system includes means for multiplexing the digital image data.

The A/D converters 20 are provided for each of the CCDs 18 such that a digital data stream is provided at a required speed into the time sequence multiplexers 26. The digital signal processor 28 organizes the data into a format that meets the display requirements. The only data that is transmitted for display is the amount of data necessary to fill the display monitor screen 32 at the control station 8. However, the seeker system is designed to process all of the data generated by the CCD array 18. Hence, only a desired portion of the image that is to be examined is shown on the display 32.

To illustrate the transmission of only the amount of data necessary to fill the display monitor screen, the following example is provided. Assume an array of 500×500 pixels in a single CCD and a TV monitor capable of displaying an image made up of 500×500 pixels. Assume also that the field-of-view of the optical system is such that an array of 3×3 CCDs is required to cover the focal plane of the optical system. The available image that can be viewed is then made up of 1500×1500 pixels of which only 500×500 pixels can be viewed at any one time on the TV monitor. Hence, in this example, the number of pixels being viewed exceeds the number of pixels that can actually be displayed at any one time by three times. Many techniques may be used to observe the entire field-of-view. First, a selection of every third pixel from the total of 1500×1500 pixel array, as in the above example, will provide the user with a reduced resolution of the image of the entire field-of-view of the optical system. Second, an average may be calculated from the pixel values surrounding the selected pixels to display a smoothed image on the monitor. Third, alternate third pixels may be displayed in a snapshot series to fully display the entire field-of-view. A combination of the above three techniques may be employed to more fully examine the field-of-view.

To increase the resolution (and magnification) of the image, however, only one of the available 500×500 pixel CCD or any part of the multiple CCDs providing the necessary 500×500 pixels may be selected. The net result would be an electronic zoom. The electronic zoom is accomplished through selection of every nth pixel to fill a display screen, where n is an integer. For example, selection of every pixel would provide a higher resolution since every pixel is viewed but a smaller area of the CCD array is viewed. Selection of every third pixel, as described above, would allow a larger area to be viewed but with a reduced resolution. Additional electronic data processing may be employed to give additional increased magnification with reduced resolution.

The addition of a zoom optical system would allow an even better resolution by effectively increasing the true magnification of the system to desired upper and lower boundaries, and by the selection of pixels that emphasize the area of interest within the array.

The reading means of the seeker system includes means for processing the digital image data including an array map, sampling means, formatting means, and storing means.

The digital signal processor 28, shown in FIG. 4, permits the user to select desired data from the CCD array 18 to be transmitted to the control station 8 for evaluation and display. The digital signal processor 28 is designed to permit the user to examine the entire field-of-regard 16 of the seeker, or only a portion of the field-of-regard 16 equivalent to a single or part of a CCD. This is accomplished by, for example and as explained above, selecting each pixel, every other pixel, every third pixel, etc., from each CCD as is necessary to fill the monitor screen 32.

Referring to FIG. 4, the digitized image signal from the A/D converters 20 are transmitted to the digital signal processor 28. The digital signal processor 28 includes a sampling circuit 40, an array map 42, a display formatter 44, and a RAM 46. The array map 42 identifies the locations of each pixel data on the CCD array 18 and defines the coordinates for each pixel in the CCD array 18 to display a picture on the display screen 32. The array map 42 also defines a central coordinate that corresponds to a portion of the image frame that is in axis alignment with the missile. Defining the central coordinate (FIG. 8) permits algorithms within the array map 42 to automatically determine the location of each individual pixel relative to the central coordinate selected for display.

The sampling circuit 40 successively samples the coordinates of a selected portion of the image frame to be examined on the array map 42, and from the multiplexers 26, actual picture or image data corresponding to the sampled coordinates are transmitted to the display formatter 44. Hence, the sampling circuit 40 interacts with the multiplexer 26 to extract only those pixels that are to be formatted and examined. The coordinates may be sampled in accordance with the central coordinate of the array map 42. Alternatively, the coordinates may be sampled manually by having the operator move a cursor positioning device from the display. The cursor, which may be a crosshair or a tracking gate that is overlaid on the target in the display, becomes the center of the image being displayed. A predetermined number of pixels surrounding the crosshair or tracking gate are sampled to be displayed. A clock 25 is provided to maintain synchronization among the A/D converters 20, multiplexers 26, and sampling circuit 40.

The display formatter 44 processes the image data from the sampling circuit 40 to a specific format required for display and routes the formatted data to the RAM 46 which stores the digitized scene to be displayed at the control station 8.

Figure 8:
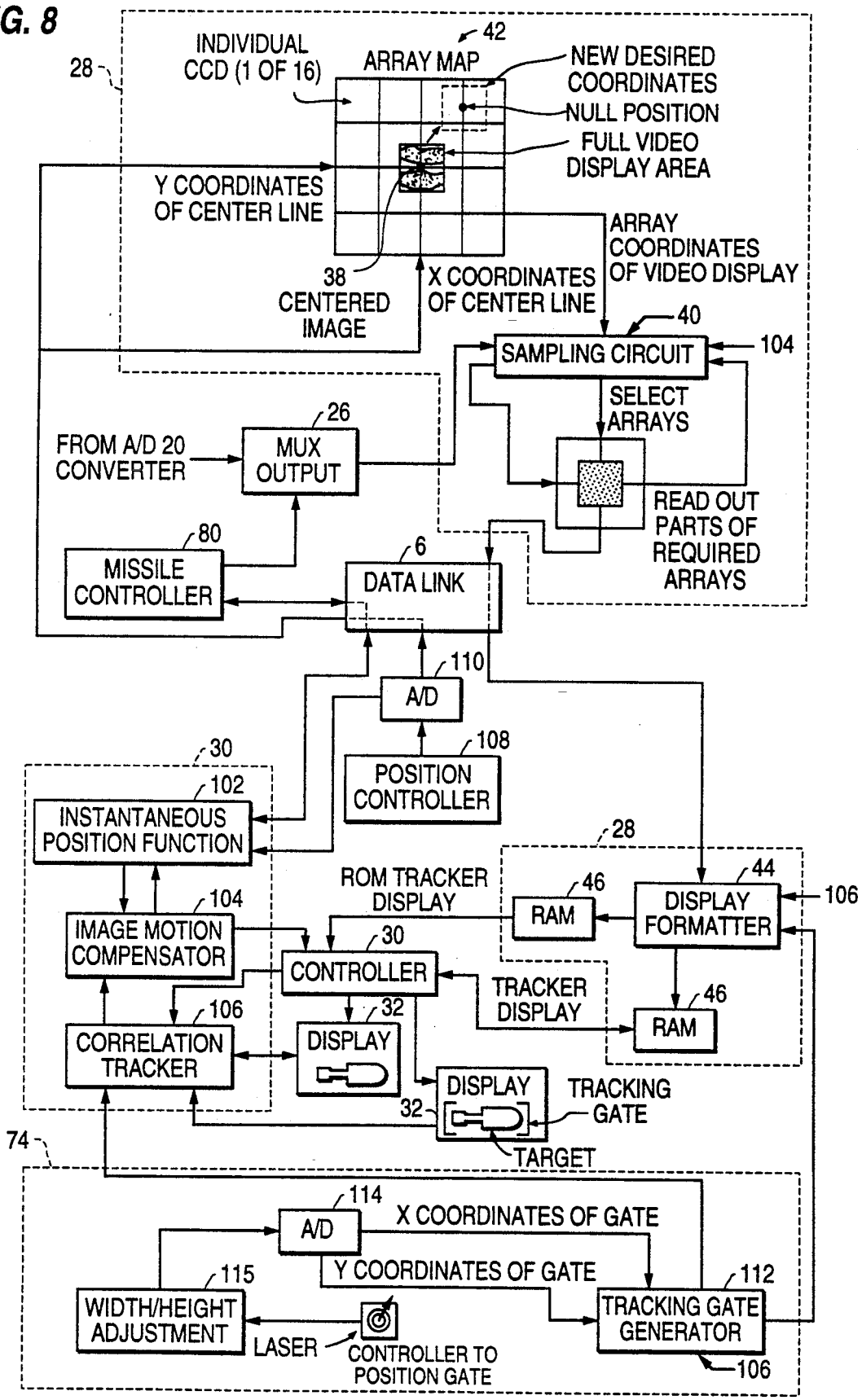
FIG. 8 is a detailed block diagram of the seeker stabilization and control unit of the system of the present invention.

As shown in FIG. 8, portions of the digital signal processor 28 may be within the airframe portion 4 and the control station 8. In this case, for example, the array map 42 and sampling circuit 40 are located in the airframe portion 4 while the display formatter 44 and the RAM 46 are located in the control station 8. The entire digital signal processor 28, however, may be located in either the airframe portion 4 or in the control station 8.

The seeker system includes means for displaying the image data of the successive image frames. While discussing the displaying means, the control station 8 will be explained in detail.

Figure 5:
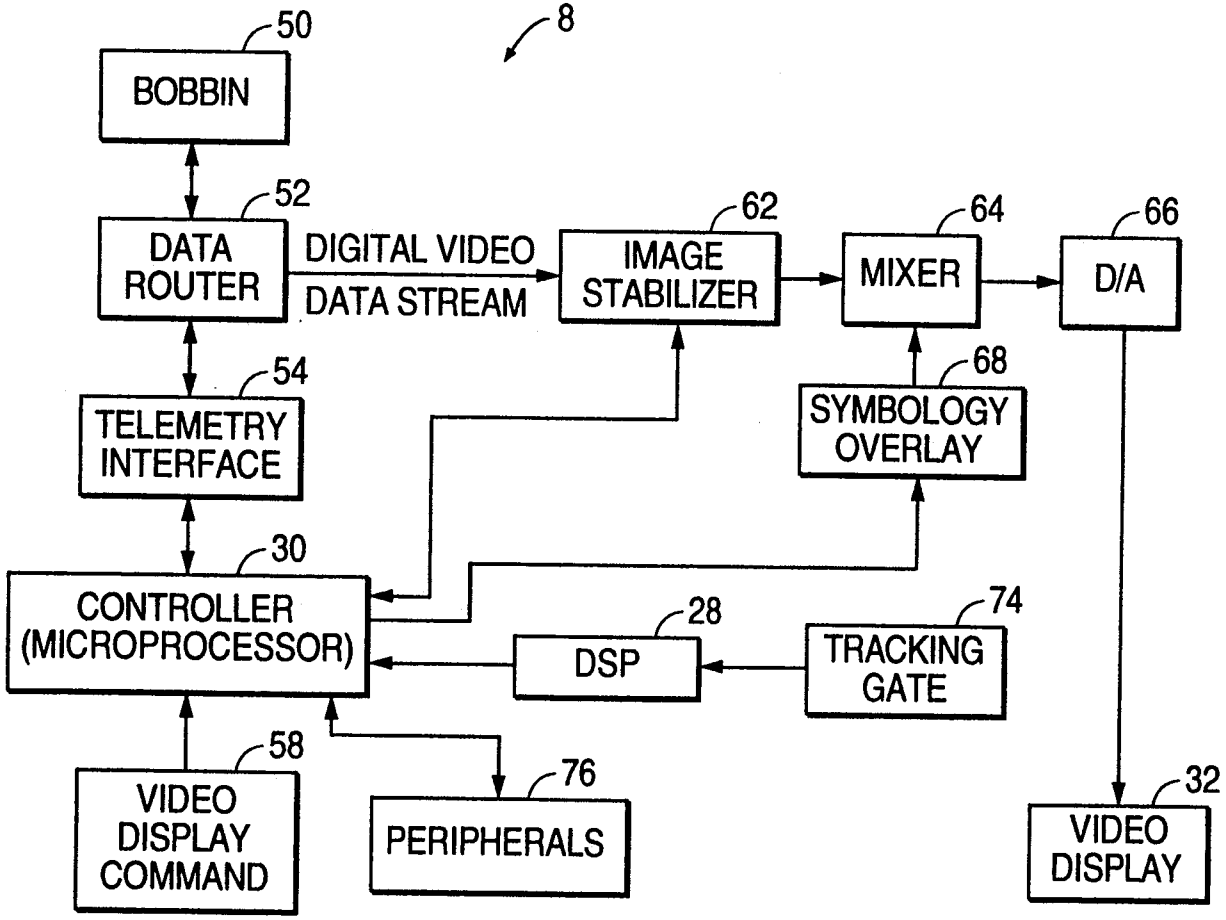
FIG. 5 is a schematic block diagram of the system of FIG. 1 illustrating in more detail an embodiment of the control station portion of the present invention.

As embodied herein and referring to FIG. 5, the control station 8 includes data router 52 (different from the data link 6), which receives data from the airframe portion 4 through a transmission medium such as fiber optic cable wound on a bobbin 50. The data router 52 separates the received data into digital video data and missile data. Digital video data are routed to the image stabilizer 62 in a stream of digital video data and missile data are routed to the controller 30 through telemetry interface 54. As shown in FIG. 2, controller 30 includes microprocessor 56, instantaneous target position 102, image motion compensator 104, and correlation tracker 106. The missile data includes data such as the rate or motion sensor data, accelerometer data and image position data. The telemetry interface 54 formats the missile data into a readable format for the microprocessor 56. The controller 30 also provides cursor positioning functions to move the cursor such as the crosshair in the display 32 as well as within the array map 42.

The digital video data stream is received by image stabilizer 62 which stabilizes the image on the display 32 through the controller 30. Due to the hard-mounting of the optical and electronic system onto the missile body, images from the missile become distorted (blurred) as a result of various physical forces such as wind, vibration and shock transmitted through the structure itself, as well as scene motions due to the missile motions relative to the scene. Hence, stabilization of the image is needed to compensate for the distorted images. The stabilized video data is mixed with symbologies, such as altitude, speed, etc., from symbology overlay 68. The mixed digital data are sent to video display 32 to display the images and symbologies through a digital to analog (D/A) converter 66. Video display command 58 supplies the microprocessor 56 with the video display command data such as the specific symbologies to be displayed. Also, the video display command 58 provides such video commands as "zoom" and "scan" commands and supplies these commands to the microprocessor 56.

Thus, the information from symbology overlay 68 is integrated with (or superimposed on) the video data from the image stabilizer 62 by a digital data mixer 64. The mixed stabilized video data is routed to digital to analog converter 66 and the resultant analog video signal from the D/A converter 66 is routed to the video display 50 for display.

The control station 8 utilizes microprocessor 56, such as the INTEL 80386, 80486 and other suitable microprocessors, to manage the control station and to send data commands to control the airframe portion 4. The microprocessor 56 receives image data from the digital signal processor 28 and generates video matrices, rotation commands, and video display addresses to be routed to the image stabilizer 62. The microprocessor 56 also receives data from a tracking gate 74 which generates a gate to be overlaid on a selected target on the display 32. In particular, the tracking gate data is received by the correlation tracker 106 within the controller 30 to maintain tracking of the target. Peripherals 76 provide such functions as generating input and output addresses, storing image frames, generating and extracting synchronizing signals, and providing symbology overlay 68, to the controller 30.

Hence, the control station 8 generates commands to keep the missile stabilized while adjusting flight path of the missile to track the target. The control station 8 also performs such function as histogram equalization to control the electronic shutter 11 and dynamic range compensation.

The seeker system of the present invention includes means for controlling the flight of the missile and means for sensing the missile motion.

Figure 7:
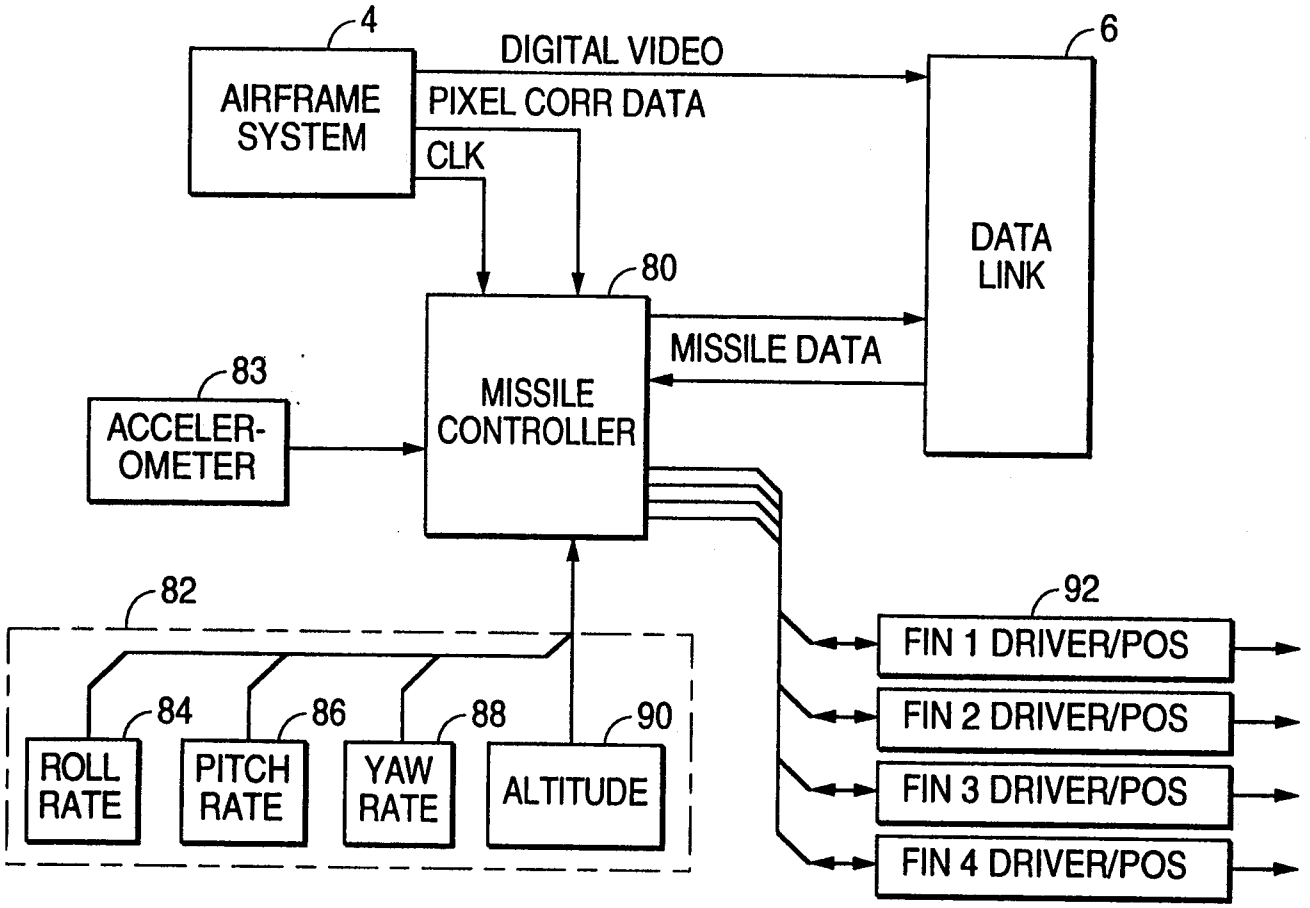
FIG. 7 is a schematic block diagram of the missile controller portion of the seeker system of the present invention.

FIG. 7 shows a block diagram of the missile controller electronics in the airframe 10 to physically control the missile. As shown in FIG. 7, the missile controller electronics includes missile controller 80, fin driver and position controller (fin driver/position) 92, and inertial unit 81 (FIG. 2), which includes rate sensors 82 (gyro package) and accelerometer 83. The rate sensors 82 include roll rate 84, pitch rate 86, yaw rate 88, and altitude 90 sensors. The missile controller 80 receives the roll, pitch, yaw, and altitude information from the roll rate 84, pitch rate 86, yaw rate 88, and altitude 90 sensors, respectively. The motions in pitch, yaw, roll and altitude are removed from the displayed image by data processing at the control station 8 through the controller 30 (FIG. 5). In particular, the controller 30, in response to the sensed rate of change of the missile, sends commands to the missile controller 80 to move or reposition the missile fins through the fin driver/position controller 92 until the missile, which if forced off course due to external forces, is back on course toward the target. Also, the missile controller 80 receives the rate of velocity change from the accelerometer 83 for use in the tracking and stabilization of the target and display. Hence, the data from the inertial unit 81 are transmitted to the missile controller 80 which interacts with the control station 8 to control the orientation and flight path to keep the missile flying in a desired direction.

The missile controller 80 supplies the fin drivers/position 92 with commands to control the fins and other surface controllers to maneuver the airframe 10 in accordance with the position commands from the control station 8. The fin drivers/position 92 operate the fin motor and provide the direction of travel in response to the missile data commands. The fins can be controlled using electronic, pneumatic, or hydraulic means. In this embodiment, the fins are controlled electronically and a circuit periodically samples the position of the fins so that the controller can correctly compensate for deviations of the missile from the set course. The missile controller 80 also receives pixel correlation data and clock signals for synchronization from the airframe portion 4.

The airframe portion 4, the two-way fiber optic data link 6, and the missile controller 80 may be integrated into one unit. The missile controller 80 is designed around a microprocessor such as the INTEL 83C51 microprocessor. Once the target is selected, the missile is maneuvered toward the target. At this point, the correlation between the main controller 30 and the missile controller 80 maneuver the missile toward the target.

It should be noted that the missile controller 80 contains an autopilot system that performs all the necessary housekeeping operations to normally fly the missile. The autopilot system uses the rate sensor data to compensate for undesired motions of the airframe 10 due to external forces so that the missile is always directed to a set course. The autopilot unit allows the field-of-view to be moved within the field-of-regard to scan the field-of-regard without actually moving the airframe 10. However, the operator may maneuver the airframe 10 manually in search of a potential target. Also, the autopilot unit allows the airframe 10 to maneuver whenever the operator moves the crosshair using the joystick controller 108 (FIG. 8) to the edge of the field-of-regard 16. This allows the joystick controller 108 to scan the field-of-regard and designate the target. After target designation, the missile is steered by keeping the tracking gate preferably at the central coordinate of the array map.

The seeker system of the present invention includes means for determining an instantaneous coordinate position of the displayed image from each successive image frame in the array map and means for calculating a distance from the determined position of the displayed image in the array map to a predetermined coordinate position in the array map.

As embodied herein and referring to FIG. 8, the controller 30 receives the image to be displayed and determines, in accordance with the instantaneous position function 102, the coordinate position of the center of the displayed image in reference to the array map 42. The instantaneous position represents the pitch and yaw electronic positions. The microprocessor 56 further determines the position of the center of the displayed image relative to the edge coordinates of the array map 42. This can be done as follows. The distance from the center of the displayed image to the central coordinate of the array map 42 may be calculated (since the central coordinate has a fixed distance to the edge coordinate) or the distance from the center of the displayed image to the nearest edge coordinate may be calculated. Other similar methods may be used to determine the position of the center of the displayed image relative to edges of the array map 42.

The seeker system of the present invention includes means responsive to the calculated distance for controlling the missile to move the center of the displayed image toward the central coordinate of the array map in accordance with the calculated distance.

Figure 9:
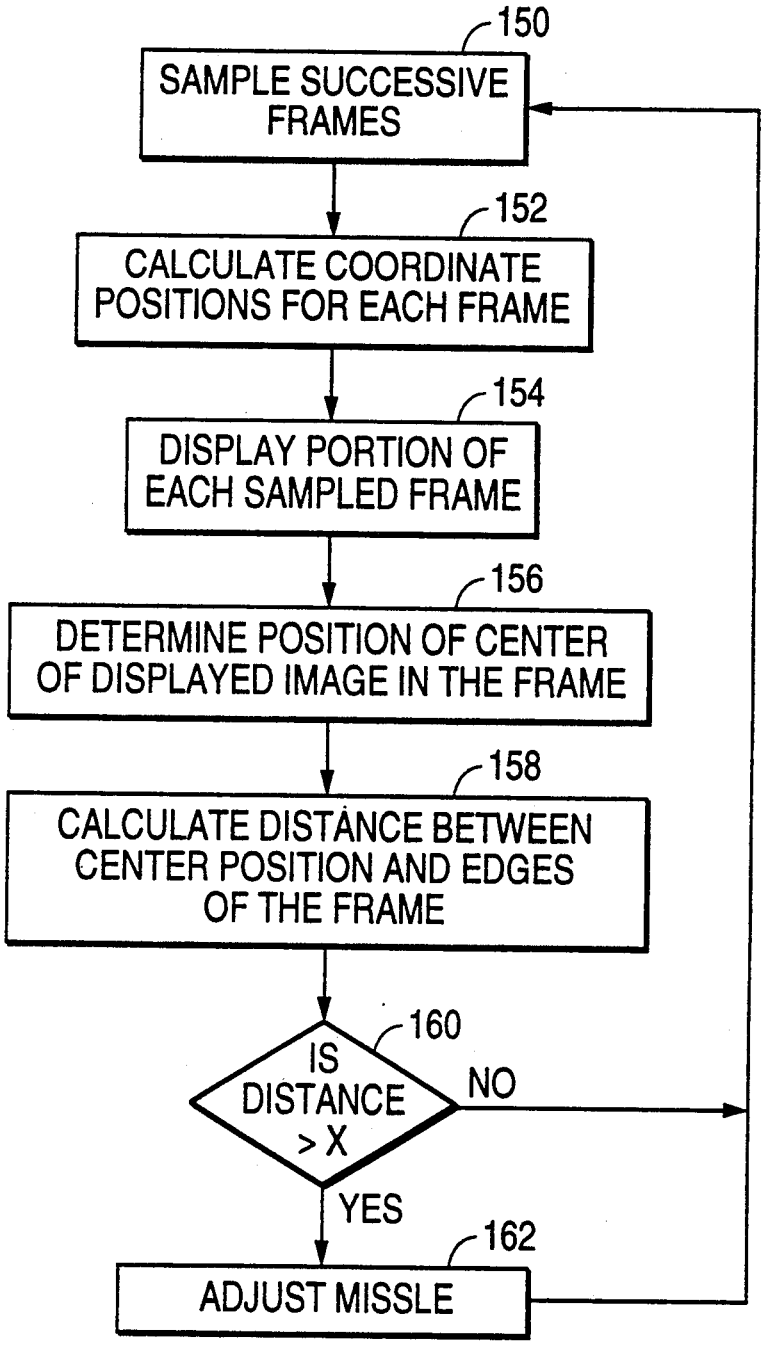
FIG. 9 is a flowchart of the missile controlling operation to maintain the center displayed image within the array map.

FIG. 9 is a flowchart of the missile controlling operation to maintain the center displayed image within the array map. Referring to FIG. 9, successive frames are sampled, as discussed earlier, in step 150. The coordinate position for each frame is calculated in step 152, and a desired portion of each frame is displayed in step 154. The coordinate position of the center of the displayed image within the array map 42 is determined in step 156. In step 158, a distance from the displayed center image coordinate to a nearest edge coordinate of the array map 42 is calculated. Once the distance from the center image to the nearest edge is determined, the microprocessor 56 determines whether the calculated distance is an acceptable or an unacceptable value in step 160. For example, if the center of the displayed image is compared with the central coordinate of the array map 42, then the distance becomes unacceptable when the distance is greater than a predetermined value. However, if the center of the displayed image is compared with the nearest edge coordinate of the array map 42, then the distance becomes unacceptable when the distance is less than a predetermined value. In either case, if the distance is unacceptable, the microprocessor 56 generates commands, which are sent to the missile controller 80, to maneuver the missile to adjust the center of the displayed image toward the central coordinate of the array map 42 in step 162.

If the sampled frames show that the center of the image 38 is not at or near the central coordinate of the array, the missile is adjusted to move the center of the displayed image 38 toward the central coordinate of the array map 42.

Normally, the missile would fly very close to the central coordinate if not at the central coordinate of the array map 42, which is aligned with the axis of the missile. However, if the target were to drift toward an edge of the array map 42 (due to a very fast moving target, for example), then the instantaneous position function 102 determines that the target is drifting toward an edge and sends commands to the missile controller 80 to maneuver the missile accordingly to keep the target within the array map 42, preferably at the central coordinate.

The rate of change of the center of the displayed image 38 (which preferably is the target) on the full array map 42 can be determined from keeping track of the history of the movement of the display centerline relative to the full array. Thus, this rate of change provides information as to how fast and at what direction the center image 38 is moving so that the missile can be maneuvered accordingly to track the target without losing the target out of the array map 42.

Also, due to vibrations and shock, for example, an instant point of the center image 38 undesirably changes at the next instant causing a distorted, blurred image. Hence, the image position data is normalized through a stabilizing technique by the controller 30 to prevent the missile from responding to such distortions.

The seeker system of the present invention includes means for tracking the selected target by setting a course of the missile in a direction toward the target.

FIG. 8 shows a detailed block diagram of the seeker stabilization and control unit. Referring to FIG. 8, using a position controller 108 such as a joy stick or a mouse, an operator may move the viewed image freely across the display screen 32 to permit a search throughout the entire array map 42 for the purpose of target detection, identification and attack.

When the operator maneuvers the missile using the position controller 108, the coordinates of this position are digitized by an A/D converter 110 and translated into coordinates of the array map 42, which is provided to the instantaneous position function 102. The instantaneous position function 102 transmits the position coordinates from the position controller 108 to the missile controller 80 which controls the fins and other surface controllers of the airframe 10 through fin driver and position controller 92 to maneuver the missile. Once a potential target has been found, the operator may manually steer the missile toward the target. If the operator does not lock on to the target, then the operator must maneuver the missile so that the potential target is maintained within the field-of-regard 16.

An operator can lock on to the target by positioning a gate over the target on the display 32 using a tracking gate 74, as shown in FIG. 9. The tracking gate 74 includes a tracking gate generator 112, an A/D converter 114, a width/height adjustment controller 116, and a gate controller 118 to position the gate, such as a joystick. Once the target has been locked on, the seeker system of the present invention automatically tracks the target.

A tracking gate generator 112 produces the gate which is placed over or superimposed on the target on the display 32 by using cursor controller 118. The width and height of the tracking gate is controlled by a width-/height adjustment device 116. The tracking gate coordinates are used by the display formatter 44 to overlay the tracking gate onto the RAM 46 and the display 32. At the same time, the tracking gate coordinates are provided as input to the correlation tracker 106 for tracking the target. The target may be maintained within the display 32 by selecting pixels on the CCD array that were not previously being viewed on the display screen 32. Hence, in this case, the missile need not be moved to keep the target within the display 32.

Once a target is selected by overlaying a gate from the tracking gate 74 over the target on the display 32, the microprocessor 56 receives the location of the tracking gate in reference to the array map 42 through the display formatter 44 and RAM 46 as shown in FIG. 8. In order to track the target, the tracking gate is initially moved to the central coordinate of the array map 42 by adjusting the tracking gate using gate position controller 118 within the array map 42 and/or adjusting the missile. From this, a course has been set from the missile in the direction toward the target. The target will be tracked continuously by maintaining the displayed target within the array map 42 and preferably at the central coordinate of the array map. However, due to external forces such as vibration and shock from wind, for example, and due to motions of the target, the seeker system must compensate for these movements while providing a stable image on the display 32.

The seeker system of the present invention includes means for comparing the image data of successive image frames.

As embodied herein and referring to FIG. 8, the microprocessor 56 receives each successive image frame through the controller 30. The correlation tracker 106 selects from the image frame a correlation point which may be the point under the crosshair, the tracking gate of the target, or a contrast differentiating area such as a bright spot in the image. The correlation point is preferably selected nearest the center of the image frame. In accordance with the selected correlation point, each successive image frame is compared with its previous image frame by calculating a difference in the pixel position of the correlation point in the array map 42 between each successive image frame and image is adjusted accordingly. It should be noted that the correlation point may be an area of multiple pixels, for example, $2\times2$, $3\times3$, etc., to fix or identify motion occurring in the image.

The seeker system of the present invention includes means responsive to the compared frames for discriminating between deviations below and above a predetermined amount. The seeker system also includes means for stabilizing the display of the images and means for repositioning the missile to the set course in response to the deviations, respectively.

Once the difference in the pixel position of the correlation point in the successive frames has been calculated, the correlation tracker 106 compares this difference with a predetermined threshold value. This threshold value determines whether the missile has to be moved to compensate for this difference or the image frame itself has to be adjusted to stabilize the image on the display. For example, if the missile has not moved and the correlation point has not moved but the correlation point does not match in the successive frames (the difference is less than the threshold value), then vibrations from the missile has undesirably moved the correlation point of the present image frame from its previous position in the previous frame. To correctly display the present image frame, the present image frame is adjusted using vector analysis, for example, so that the correlation point matches its position in the previous frame. From this, a stable scene can be achieved on the display. In other words, changes in the position of the present image frame on the CCD array 18 in reference to the previous frame are removed such that the present scene overlays (matches or correlates) the previous scene.

However, if the missile has moved or if the correlation point has moved (the difference is greater than the threshold value), then the missile is maneuvered to continue to track the correlation point until impact of the target. In particular, the missile is maneuvered such that the target is positioned at or near the central coordinate of the array map 42.

If the missile has moved to create a difference greater than the threshold value as discussed above and if this difference is very large such that the correlation point is not even in the array map 42 (i.e. out of the field-of-regard), then the image motion compensator 104 interacts with the missile controller 80 to reposition the missile such that the correlation point is back in the array map 42. Once the correlation point is within the array map 42 again, the correlation tracker 106 correlates the frames to continue the stabilization and tracking of the target.

The microprocessor 56 may select the correlation point which may change as a function of time as the old correlation point may leave the field-of-regard (array map 42) and new features become visible. This would be helpful, for example, when the missile is very close to the target. In this situation, images on the screen may change rapidly and a "blooming effect" may arise on the display due to the closeness of the target. However, by having the microprocessor 56 automatically select the correlation point as a function of time, the system is not adversely affected by the blooming effect.

Hence, the correlation tracker 106 manages small scale motions while the image motion compensator 104 manages large scale motions. Small scale motions are motions small enough that the correlation point has not moved a predetermined threshold amount from one successive frame to the next. Large scale motions are motions large enough that correlation point has moved greater than or equal to the predetermined threshold amount from one successive frame to the next or the missile is thrown off course and the correlation point is no longer within the consecutive frames (out of the field-of-regard). Hence, if a change in motion is small, the correlation tracker 106 can correct (correlate) the small change in motion. However, if a change is large, the image motion compensator 104 use the autopilot and the correlation tracker 106 to compensate for this large motion change.

Other suitable correlation techniques may be used to correlate the frames. For example, edges of the frames may be compared and any difference in the edges of the two frames may be adjusted accordingly to correlate the frames.

The adjustment required to correlate the frames is provided both to the sampling circuit 40 and to the instantaneous position function 102. Hence, if necessary (when the missile has changed positions at a large scale in reference to the target, for example), the missile is automatically steered to correspond the frames. A running log of the position shifts is retained and when successive data show a motion trend towards the edge of the display, the image motion compensator 104 defines a new array position and updates the sampling circuit 40, thereby closing the tracking loop. Hence, this technique is forward driven such that changes in the image are accepted as a function of time.

Further, the image stabilization can be accomplished by sensing the change in missile centerline orientation between the array map 42 and a target and selecting a new set of pixels that positions the image of the target in a fixed position in the array map. In other words, a coordinate transformation is performed. To do this, a high speed system would be required that is capable of sampling image frames and sending data from the inertial unit 81 to the missile controller 80 and the image motion compensator 104 at a very high rate to perform the necessary functions, including missile adjustment, if necessary, to select the new set of pixels to be displayed. Hence, the high speed allows the image to be viewed as if the target were fixed on the display screen.

It should be noted that the operation of image stabilization is continuous whether the missile is steered manually or the missile is maneuvered automatically to keep the target within the field-of-regard (array map 42).

Figure 10A:
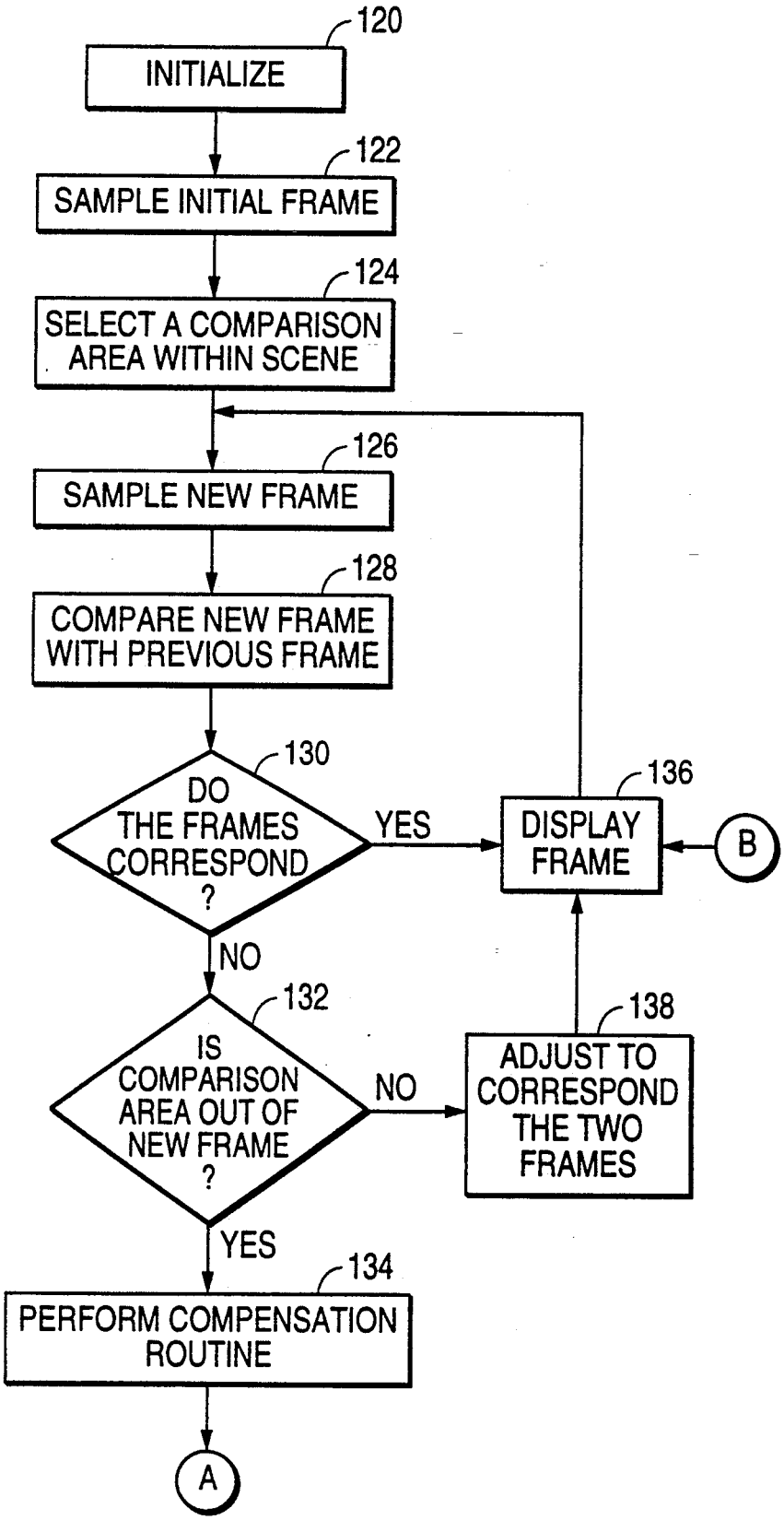
FIGS. 10A and 10B are flowcharts of the operation of the seeker stabilization and control unit of the system of the present invention.
Figure 10B:
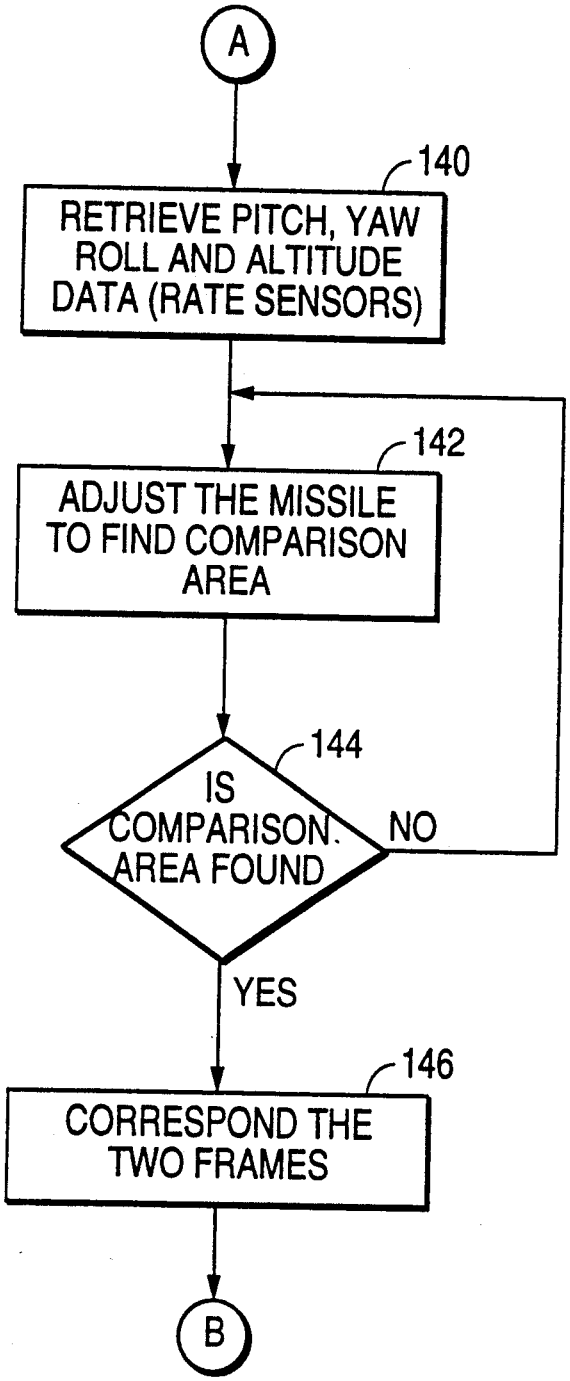

The operation of the stabilization and tracking of the seeker system of the present invention is now explained in reference to FIGS. 10A and 10B.

FIGS. 10A and 10B are flowcharts of the operations of the seeker stabilization and control unit. As shown in FIG. 10A, after the initialization and the operation begins, i.e., the optical system begins to pass images to the seeker system, and an initial frame is sampled by the airframe 4 at step 122. At step 124 a comparison area or correlation point within the frame is chosen. The correlation point can be the target itself or a contrast differentiating area (a bright spot, for example) in the frame. The target is normally selected as the correlation point unless the target area is of very low contrast compared to the background such that it is difficult to set the difference in contrast. In this case, an area of high contrast preferably closest to the center of the frame is used as the correlation point. A new and successive frame is sampled at step 126 which is compared with the previous frame at step 128. If the new frame and the previous frame correspond, i.e., the correlation point of the frames matches, then the frame is displayed, as shown in steps 130 and 136. If the frames do not correspond, then it is determined whether the correlation point is in the new frame, as shown in step 132. If the correlation point is in the new frame (but does not correspond), either the missile is adjusted or the new frame itself is adjusted to correlate the new frame with the previous frame (steps 138) as follows. A difference in distance between the correlation point of the new frame and the previous frame is calculated. If the difference is less than a predetermined value, the new frame itself is adjusted to correspond to the previous frame by matching the correlation point of the new frame to the previous frame and the new frame is displayed. If the difference is greater than the predetermined value, which means that the missile is shifting out of course, the missile is maneuvered so that the correlation point of the frame sampled immediately after the maneuver matches the correlation point of the previous frame that is being compared and the newly sampled frame is displayed.

If the correlation point is not in the new frame, the position of the missile has shifted out of course (due to external forces such as a large vibration or shock) such that the correlation point is no longer in the frame. In this case, a compensation routine is performed in step 134 to position the missile back to its proper course.

The compensation routine is shown in FIG. 10B. The compensation routine incorporates the missile autopilot to realign the missile back to the proper course and to correlate the frames. As discussed previously, the rate sensor data in conjunction with the fin position data are sent to the missile controller 80 which communicates with the control station 8 to provide the necessary data commands to control the fins to realign the missile. The adjustment to realign the missile is done until the correlation point is found (step 144). Once the correlation point is found, the latest frame is adjusted again to correspond with the frame before the shift occurred (step 146), as in step 138 of FIG. 10A. The latest or new frame is displayed on the display 32. This process is repeated for each successive frame.

Thus, the instantaneous position function 102, image motion compensator 104, and correlation tracker 106, interact with each other to stabilize the image on display 32 and to control the missile. This technique of stabilization is more stable than a mechanical gimbal system because compensation for moving parts due to inertia is not necessary in the seeker system.

Once a target is selected, the selected target may be used as the contrast differentiating area or correlation point and the target is tracked by locking the tracking gate 74 onto the target. This is done, as discussed earlier, by having the consecutive frames to correlate with each other to maneuver the missile toward the target. In other words, while tracking the target, the position of the observed set of pixels, which create the display image relative to the overall set of CCDs, can be used to move the control surfaces, as necessary, to drive the state vector of the missile for automatic control to maintain the image on the array map 42. Thus, the tracking gate 74 assures the operator that the missile autopilot and navigation system is informed that the selected region (region being displayed) contains the target to be impacted. Then, the correlation tracker 106 uses the tracking gate 74 as the correlation point to maintain the line of sight of the seeker. Commands are determined from the tracking gate position on the CCD array 18 to drive the tracking gate 74 and to intercept the state vector of the missile.

Therefore, the seeker system of the present invention does not require a mechanical gimbal system to track targets while inherently compensating for the missile motion, shock and vibration, and calculating the position shift parameters of the target.

The seeker system can be programmed to automatically sweep the target area through the field-of-regard 16 to seek out and select a target. The pixels needed to produce an image on the display 32 are transmitted to the display 32 in a cyclic manner. Combined with the electronic stabilization, the seeker system automatically sweeps the target area while compensating for the undesired effects of the missile motion.

Although a considerable amount of electronics is designed into the control station, a portion or practically all of the control station electronics may be placed in the missile to provide a more automated seeker system. For example, instead of having the operator locate the target from the display and designate the target, as is done in the first and second embodiments, the missile system can be designed to automatically perform the operations. The designation Of the target may be performed by an image recognition system to select and then lock onto the target. Also, instead of focusing the image onto a CCD array, the CCD array can be replaced by an imaging infrared detector array to operate the system at night, an ultraviolet array, or any array suitable for detecting images.

In addition, for much larger arrays which may be implemented in the future, pixel selection may be made within the airframe 2 to meet control station display requirements. Also, the pixel selection may be made within the airframe portion 4 to reduce the data transmission volume to the control station 8.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A seeker system for a missile having a housing, the system comprising:

means adapted to be fixedly mounted to the housing for detecting images, said detecting means having a predetermined number of pixels;

an optical system adapted to be fixedly mounted to the housing disposed to scan a predetermined field-of-regard from the housing for focusing images in successive image frames onto the image detecting means;

means for reading image data from the image detecting means corresponding to each of the successive image frames, said reading means including an array map having coordinates for locating each of the pixels of each successive image frame, said array map including a central coordinate;

means for displaying a portion of the image data of each of the successive image frames from the array map;

means for determining an instantaneous coordinate position of the center of the displayed image from each successive image frame in the array map;

means for calculating a distance from the determined position of the center of the displayed image in the array map to a predetermined coordinate position in the array map; and means responsive to the calculated distance for controlling the missile to move the center of the displayed image toward the central coordinate of the array map in accordance with the calculated distance.

2. The seeker system according to claim 1, wherein the predetermined coordinate of the array map is the central coordinate of the array map and the missile is controlled to move the center of the displayed image toward the central coordinate at times when the calculated distance is greater than a predetermined value.

3. The seeker system according to claim 1, wherein the predetermined coordinate of the array map is an edge coordinate of the array map and the missile is controlled to move the center of the displayed image toward the central coordinate at times when the calculated distance is less than a predetermined value.

4. The seeker system according to claim 1, further including means for selecting a target from the displayed image.

5. The seeker system according to claim 4, further comprising:

means for selecting a correlation point in the successive image frames;

means for comparing the correlation point of the successive image frames;

means for tracking the selected target by setting a course of the missile in a direction toward the target;

means responsive to the compared frames for discriminating between a first deviation below a predetermined amount and a second deviation above the predetermined amount;

means responsive to the first deviation for stabilizing the display of the images; and means responsive to the second deviation for repositioning the missile to the set course.

6. The seeker system according to claim 5, wherein the selecting means selects the correlation point as a function of time.

7. The seeker system according to claim 5, wherein the correlation point is the selected target.

8. The seeker system according to claim 5, wherein the correlation point is a contrast differentiating area in the image frames.

9. The seeker system according to claim 5, wherein said comparing means compares pixel position of the correlation point in each of the successive image frames with the pixel position of the correlation point in a preceding successive image frame to calculate the first and second deviations.

10. The seeker system according to claim 5, wherein said tracking means comprises means for determining an instantaneous coordinate position of the target in each successive image frame in the array map, said target tracking means, in response to each determined instantaneous position of the target, aligning the target with the axis of the missile placing the target at the central coordinate of the array map to set a course of the missile in a direction toward the target.

11. The seeker system according to claim 9, wherein said stabilizing means adjusts the pixel position of the correlation point to match the pixel position of the correlation point of each of the successive frames.

12. The seeker system according to claim 5, wherein said repositioning means comprises:

a sensor for sensing a rate of change of pitch, yaw, roll and altitude of the missile; and means responsive to the sensed rate of change of the missile for maneuvering the missile to the set course controlled by the target tracking means.

13. The seeker system according to claim 1, wherein said image detecting means is a charge-coupled device (CCD) array.

14. The seeker system according to claim 13, wherein said image detecting means further includes a fiber optic bundle, the image being focused onto the CCD array through the fiber optic bundle.

15. The seeker system according to claim 14, wherein said fiber optic bundle is divided into a plurality of smaller bundles, each said plurality of smaller bundles transmitting a portion of the image to a corresponding CCD of the CCD array.

16. The seeker system according to claim 1, wherein said image detecting means is an infrared focal plane array.

17. The seeker system according to claim 1, wherein said optical system includes an electronic shutter having a variable shutter speed for controlling the amount of light on the image detecting means for generating repetitively individual frames of the images in succession.

18. The seeker system according to claim 1, further including means for converting each of the successive image frames from the image detecting means into digital image data.

19. The seeker system according to claim 18, wherein the reading means further comprises:

means for multiplexing the digital image data with the coordinate locations;

means for sampling the multiplexed image data corresponding to a selected portion of the coordinates of the array map; and means for display formatting said sampled image data.

20. The seeker system according to claim 19, further comprising means for storing the formatted image data.

21. The seeker system according to claim 4, further comprising means for sensing changes in missile centerline orientations between the array map and the target and selecting a new set of pixels that positions the target image in a fixed position in the display means.

22. A seeker system for a missile having a housing for tracking a target, the system comprising:

means fixedly mounted to the housing for detecting images, the detecting means having a predetermined number of pixels;

an optical system fixedly mounted to the housing disposed to scan a predetermined field-of-regard for focusing images in successive image frames onto the image detecting means;

means for reading image data from the image detecting means corresponding to each of the successive image frames;

means for displaying the image data of the successive image frames, the target being selected from the image frames;

means for selecting a correlation point in the successive image frames;

means for comparing the correlation point of the successive image frames;

means for tracking the selected target by setting a course of the missile in a direction toward the target;

means responsive to the compared frames for discriminating between a first deviation in target position below a predetermined amount and a second deviation in the target position above the predetermined amount;

means responsive to the first target position deviation for stabilizing the display of the images; and means responsive to the second target position deviation for repositioning the missile to the set course.

23. A method for directing a missile to track a target, the missile having a housing with a predetermined field-of-regard, the method comprising the steps of:

optically scanning said predetermined field-of-regard from said housing;

generating successive image frames from the optical scanning;

detecting the successive image frames;

reading image data corresponding to each of the successive image frames;

displaying the image data of each of the successive image frames;

selecting a displayed target image from the field-of-regard;

comparing the image data of the successive image frames;

tracking the selected target image by setting a course of the missile in a direction toward the target image;

discriminating, responsive to the compared frames, between a first target position deviation in the successive frames below a predetermined amount and a second target position deviation in the successive frames above the predetermined amount;

stabilizing display of the images in response to the first target position deviation; and repositioning the missile to a desired course in response to the second target position deviation.

24. A method for directing a missile to track a target according to claim 23, further comprising the step of converting the image data from each of the successive image frames into digital image data.

25. A method for directing a missile to track a target according to claim 24, wherein the reading step comprises the steps of:

allocating coordinate positions for each pixel of the image data in each image frame;

multiplexing the digital image data with the coordinate positions;

sampling the multiplexed image data corresponding to a selected portion of the coordinate positions from each image frame;

formatting the sampled image data for display; and storing the formatted image data.

26. A method for directing a missile to track a target according to claim 25, wherein the comparing step includes the step of comparing the coordinate position of the target image in each of the successive image frames with the coordinate position of the target image in a preceding successive image frame to calculate the first and second target position deviations.

27. A method for directing a missile to track a target according to claim 25, wherein the tracking step comprises the steps of:

determining an instantaneous coordinate position of the target image in each successive image frame; and aligning the target image with the axis of the missile and placing the target image at a central coordinate of the image frame to set a course of the missile in a direction toward the target in response to each determined instantaneous coordinate position of the target image.

28. A method for directing a missile to track a target according to claim 25, wherein the stabilizing step includes the step of adjusting the coordinate position of the target image to match the coordinate position of the target image of each of the successive frames.

29. A method for directing a missile to track a target according to claim 23, wherein the repositioning step comprises steps of:

sensing a rate of change of pitch, yaw, roll and altitude of the missile; and maneuvering the missile to the set course controlled by the target tracking step in response to the sensed rate of change of the missile.

30. A method for directing a missile to track a target according to claim 23, further comprising the steps of:

determining an instantaneous coordinate position of the displayed target image from each successive image frame;

calculating a distance from the determined instantaneous coordinate position of the displayed target image in the image frame to a predetermined coordinate position; and controlling the missile to move the displayed target image toward a central coordinate position in response to the calculated distance.

31. A method for directing a missile to track a target according to claim 30, wherein the predetermined coordinate position in the calculating step is the central coordinate position and the missile is controlled to move the displayed target image toward the central coordinate at times when the calculated distance is greater than a predetermined value.

32. A method for directing a missile to track a target according to claim 30, wherein the predetermined coordinate position in the calculating step is an edge coordinate of the image frame and the missile is controlled to move the displayed target image toward the central coordinate at times when the calculated distance is less than a predetermined value.

33. The seeker system according to claim 22, further comprising the step of sensing changes in missile centerline orientations between the image frame and the target and selecting a new set of pixels that positions the target image in a fixed position in the display.

* * * * *